US008920935B2

(12) United States Patent
Dunleavy et al.

(10) Patent No.: US 8,920,935 B2
(45) Date of Patent: Dec. 30, 2014

(54) MECHANICAL COMPONENT COMPRISING AN INSERT MADE OF COMPOSITE

(75) Inventors: Patrick Dunleavy, Palaiseau (FR); Jean-Michel Patrick Maurice Franchet, Paris (FR); Gilles Charles Casimir Klein, Mery sur Oise (FR); Richard Masson, Buc (FR)

(73) Assignees: SNECMA, Paris (FR); Messier-Bugatti-Dowty, Velizy-Villacoublay (FR)

( * ) Notice: Subject to any disclaimer, the term of this patent is extended or adjusted under 35 U.S.C. 154(b) by 1285 days.

(21) Appl. No.: 12/670,786

(22) PCT Filed: Jul. 10, 2008

(86) PCT No.: PCT/FR2008/001014

§ 371 (c)(1),
(2), (4) Date: Jun. 18, 2010

(87) PCT Pub. No.: WO2009/034263

PCT Pub. Date: Mar. 19, 2009

(65) Prior Publication Data

US 2010/0291339 A1 Nov. 18, 2010

(30) Foreign Application Priority Data

Jul. 26, 2007 (FR) ..... 07 05453

(51) Int. Cl.

| | |
|---|---|
| ***C22C 49/14*** | (2006.01) |
| ***C22C 47/06*** | (2006.01) |
| ***C22C 47/04*** | (2006.01) |
| ***C22C 47/14*** | (2006.01) |
| ***C22C 49/04*** | (2006.01) |
| *C22C 47/02* | (2006.01) |

(52) U.S. Cl.

CPC ..... *C22C 47/064* (2013.01); *C22C 47/04* (2013.01); *C22C 47/14* (2013.01); *C22C 49/04* (2013.01); *B22F 2999/00* (2013.01)

USPC ..... 428/614

(58) Field of Classification Search

None

See application file for complete search history.

(56) References Cited

U.S. PATENT DOCUMENTS

| | | | | |
|---|---|---|---|---|
| 3,033,487 | A | 5/1962 | Walker | |
| 3,668,748 | A * | 6/1972 | Divecha et al. | 29/419.1 |

(Continued)

FOREIGN PATENT DOCUMENTS

| | | |
|---|---|---|
| AU | 31714 71 | 2/1973 |
| DE | 100 05 250 | 8/2000 |

(Continued)

OTHER PUBLICATIONS

U.S. Appl. No. 12/670,767, filed Jan. 26, 2010, Dunleavy, et al.

(Continued)

*Primary Examiner* — Adam Krupicka

(74) *Attorney, Agent, or Firm* — Oblon, Spivak, McClelland, Maier & Neustadt, L.L.P.

(57) ABSTRACT

A method of manufacturing a mechanical component, a mechanical component thus obtained, and a winding device designed for implementing the method of manufacture. The mechanical component includes at least one insert made of metal matrix composite, within which matrix ceramic fibers extend, the composite insert being obtained from a plurality of coated filaments each including a ceramic fiber coated with a metal sheath, the method including manufacturing at least one insert by winding a bonded lap or bundle of coated filaments about a component of revolution. At least some of the winding is performed in a rectilinear direction.

8 Claims, 8 Drawing Sheets

(56) References Cited

U.S. PATENT DOCUMENTS

| | | | | |
|---|---|---|---|---|
| 3,669,364 | A | 6/1972 | Sinizer et al. | |
| 6,698,645 | B1 | 3/2004 | Buchberger et al. | |
| 2006/0225252 | A1 | 10/2006 | Shindo et al. | |
| 2006/0231586 | A1 | 10/2006 | Blanchard et al. | |
| 2006/0269746 | A1 | 11/2006 | Franchet et al. | |
| 2007/0051455 | A1 | 3/2007 | Franchet et al. | |
| 2008/0131630 | A1* | 6/2008 | Schnelz | 428/34.1 |
| 2008/0210365 | A1 | 9/2008 | Franchet et al. | |

FOREIGN PATENT DOCUMENTS

| | | |
|---|---|---|
| EP | 1 652 974 | 5/2006 |
| GB | 803 270 | 10/1958 |

OTHER PUBLICATIONS

U.S. Appl. No. 13/002,514, filed Jan. 4, 2011, Dunleavy, et al.
U.S. Appl. No. 13/002,580, filed Jan. 4, 2011, Dunleavy, et al.

* cited by examiner

MECHANICAL COMPONENT COMPRISING AN INSERT MADE OF COMPOSITE

BACKGROUND OF THE INVENTION

The present invention relates to a mechanical component comprising an insert made of composite of the type consisting of ceramic fibers in a metal matrix, and to a method of manufacturing this mechanical component and to a winding device designed to implement the method of manufacture. The invention applies to any kind of mechanical component the purpose of which is to transmit a tensile and/or compressive force chiefly in one direction.

In the field of aeronautical engineering in particular, there is a constant drive toward optimizing the strength of mechanical components for minimal mass and size. Hence, certain mechanical components may have an insert made of metal matrix composite, it being possible for such components to be of one piece. A composite such as this comprises a metal alloy matrix, for example made of titanium Ti alloy, within which fibers, for example ceramic silicon carbide SiC fibers, extend. Such fibers have a far higher tensile and compressive strength than titanium. It is therefore mainly the fibers that react the load, the metal alloy matrix acting as a binder connecting to the remainder of the component, as well as protecting and insulating the fibers, which have not to come into contact with one another. Furthermore, the ceramic fibers are resistant to erosion, but it is essential that they be reinforced with metal.

The composites as described hereinabove are known for their use, in the field of aeronautical engineering, in the manufacture of disks, shafts, the bodies of actuating cylinders, casings, struts or as reinforcements for one-piece components such as vanes.

DESCRIPTION OF THE PRIOR ART

One technique for manufacturing these components is described in document FR 2886290 , which represent the technological background of the invention, in which document one of the essential steps in the manufacture consists in winding a bundle or lap of coated filaments around a circular component of revolution perpendicular to the axis of rotation thereof. The described components obtained in this way are of circular type and are mainly suited to the production of circular components such as shafts, the bodies of actuating cylinders, casings or disks.

However, some mechanical components require properties that differ from those exhibited by circular components. This is particularly the case of rods, which are essentially oblong in shape, and the purpose of which is to transmit a tensile and/or compressive load in one direction.

SUMMARY OF THE INVENTION

One particular subject of the invention is a method of manufacturing the mechanical component comprising at least one insert made of a composite of the type consisting of ceramic fibers in a metal matrix that is capable of transmitting tensile and/or compressive loads in one direction between its ends.

To this end, the invention relates to a method of manufacturing a mechanical component comprising at least one insert made of metal matrix composite, within which matrix ceramic fibers extend, the composite insert being obtained from a plurality of coated filaments each comprising a ceramic fiber coated with a metal sheath, the method involving manufacturing at least one insert with a step of winding a bonded lap or bundle of coated filaments about a component of revolution. According to the invention, at least some of the winding is done in a rectilinear direction.

The mechanical component thus obtained, for example a rod, is advantageously able to transmit tensile and/or compressive loads in one direction.

The invention also relates to a winding device specially designed to implement the method of manufacture according to the invention.

BRIEF DESCRIPTION OF THE DRAWINGS

Further advantages and features of the invention will become apparent from reading the detailed description which follows, with reference to the attached drawings in which.

DESCRIPTION OF THE PREFERRED EMBODIMENTS

The techniques of manufacturing a mechanical component comprising an insert made of composite, as described in document FR 2886290 , can be used in the context of the present invention. Thus, the teaching of that document is to be considered to be incorporated into this application and, for example, and nonlimitingly, the structure of the coated filaments, the manufacture thereof, the manufacture of a bonded lap of coated filaments, the securing of this lap either to the metal support onto which it is wound or onto the lap of the layer below, the laser-welding of the filaments or their welding by contact between two electrodes, the hot isostatic compaction and machining.

Figure 1:
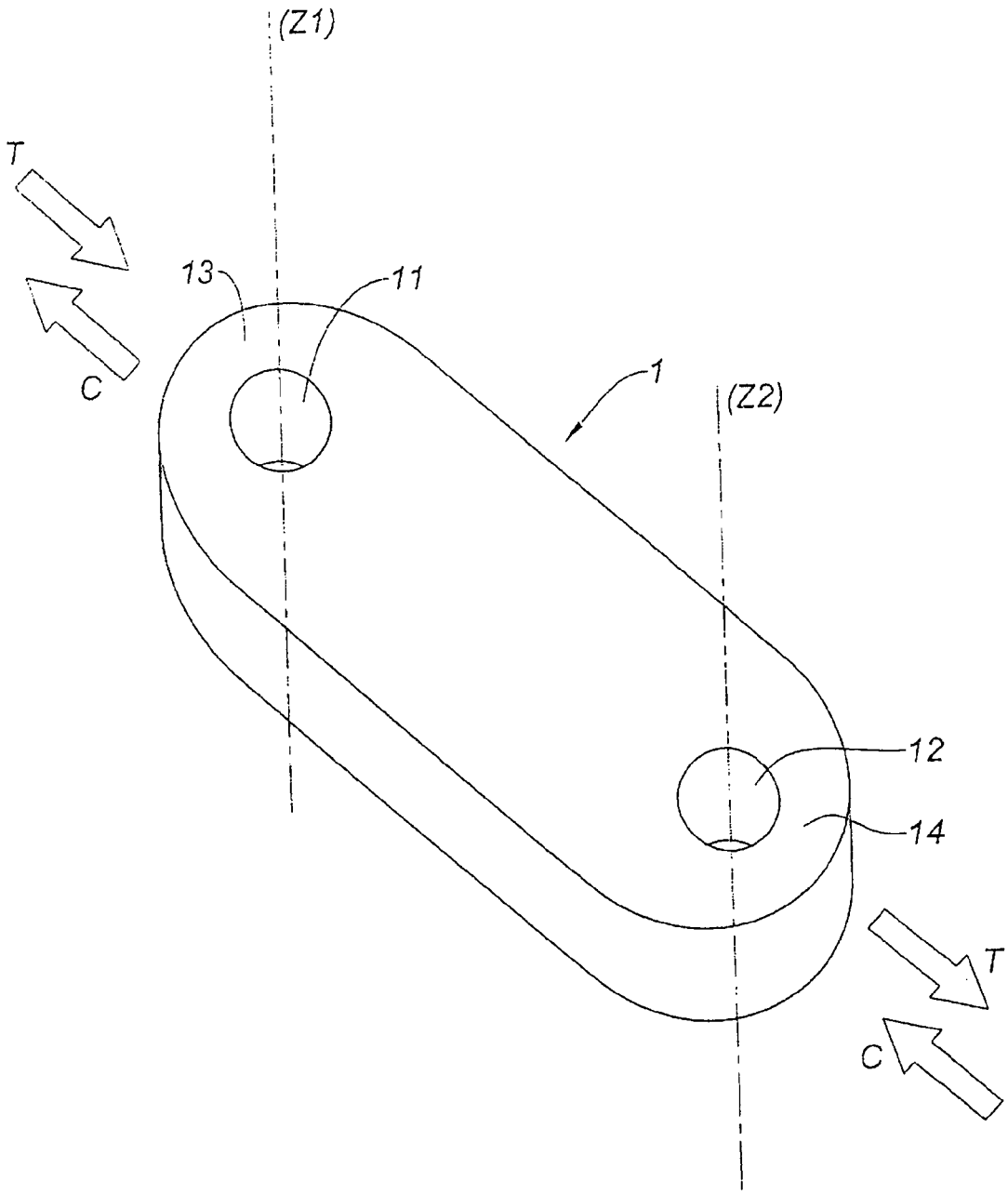
FIG. 1 is a perspective view of one example of a mechanical component according to the prior art.

FIG. 1 depicts one example of a mechanical component such as a rod 1 the shape of which is oblong overall, that is to say of elongate shape. It has two ends 13 and 14. The purpose of a rod 1 is to transmit a movement and/or tensile T and/or compressive C forces between two components articulated to the ends thereof about parallel axes Z1 and Z2. The rod 1, at each of its ends 13 and 14, has a cylindrical recess 11 or 12, the axes of which correspond to the parallel axes Z1 and Z2. This type of rod 1 may be used, for example, in the design of undercarriages or in that of turbomachines comprising thrust rods.

Figure 2:
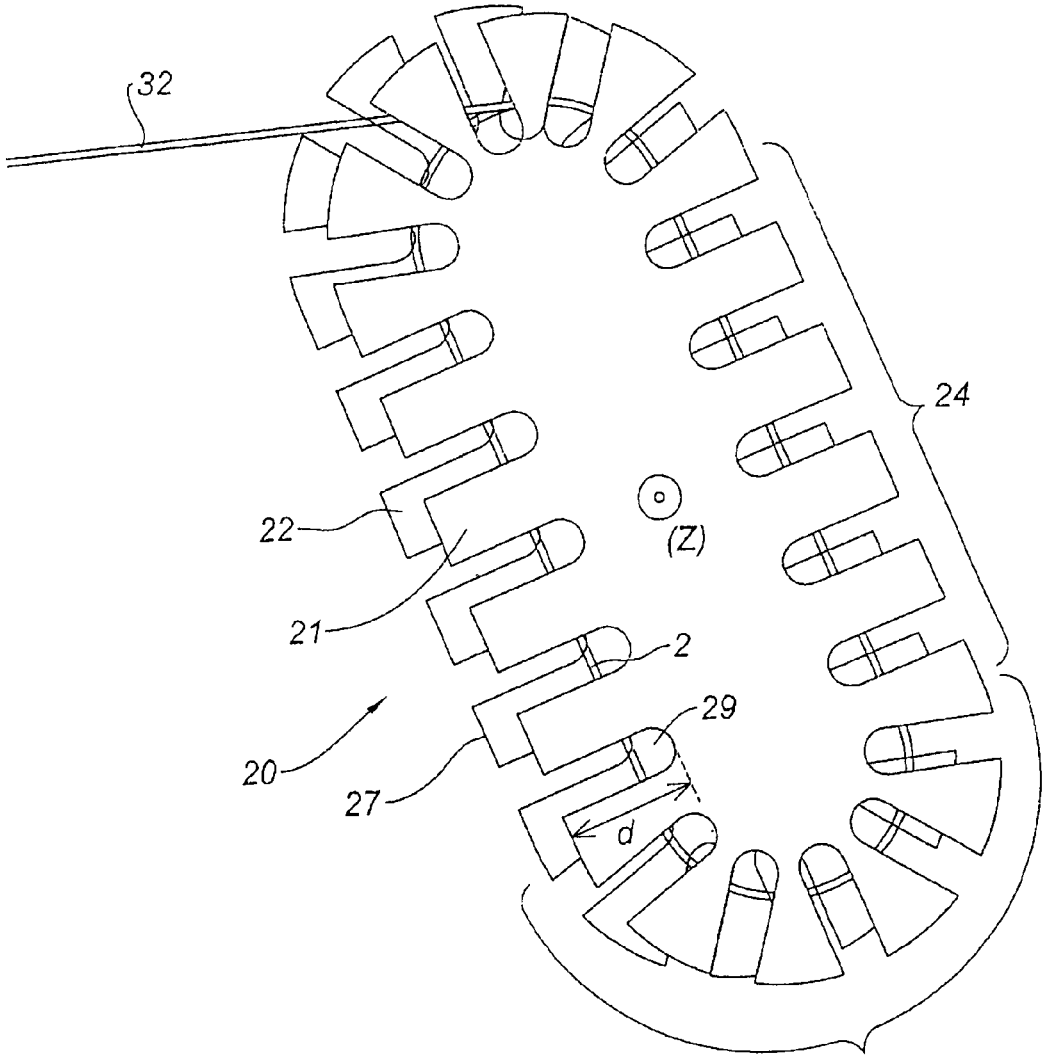
FIG. 2 is a perspective view of one example of a winding device according to the invention.

FIG. 2 depicts an example of a winding device 20 according to the invention. In this example, the winding device 20 is particularly well suited to create an insert 3 for a mechanical component such as a rod. This winding device 20 comprises a component 2 of revolution that is hollow and of oblong shape acting as a mandrel and two end plates 21 and 22 of oblong shape and substantially identical. The component of revolution 2 has a geometry of revolution, that is to say a geometry that describes a closed structure, usually curved. The dimensions of the end plates 20 and 22 are greater than the dimensions of the component of revolution 2 which means that the periphery 27 of each end plate 21 and 22 extends beyond the periphery of the component of revolution 2. The component of revolution 2 is sandwiched between the end plates 21 and 22. The filaments 32 are wound onto the component of revolution 2 when the winding device 20 is rotated about the winding axis Z. The end plates 21 and 22 axially retain the coated filaments 32 and wind them.

The winding device 20 belongs to an assembly that forms a winding system. The winding system further comprises means for rotating the winding device 20 and means for supplying a bonded lap or bundle of coated filaments 32.

The component of revolution 2 comprises two rectilinear winding portions 24. These rectilinear winding portions are directed perpendicular to the winding axis Z. Thus, at least some of the winding of the filaments 32 about the component of revolution 2 is done in a rectilinear direction. The winding of the coated filaments 32 is performed perpendicular to the winding axis Z, or in other words, the coated filaments 32 are directed substantially perpendicular to the winding axis Z.

In the example depicted in FIG. 2, these rectilinear winding portions 24 are parallel and fitted in between two circular portions 25. It is possible to vary the dimensions of the component of revolution 2, particularly its thickness in the axial direction Z, the length of the rectilinear winding portions 24 and the radius of curvature of the circular parts 25, according to the dimensions of the desired insert 3. The circular parts 25 may also have different radii. Thus, the rectilinear winding portions 24 may be non-parallel.

Winding around the component of revolution 2 comprising rectilinear winding portions 24 makes it possible, in a short space of time, to generate an insert 3 having at least one rectilinear generatrix consisting of a great many parallel and uni-directional coated filaments 32.

The insert 3, once wound, can be removed from the winding device 20 by detaching the end plates 21 and 22 from one another. The shape of the insert 3 thus formed needs to be set so as to prevent the filaments 32 from losing their orientation. There are various techniques that can be employed to achieve this.

Figure 3:
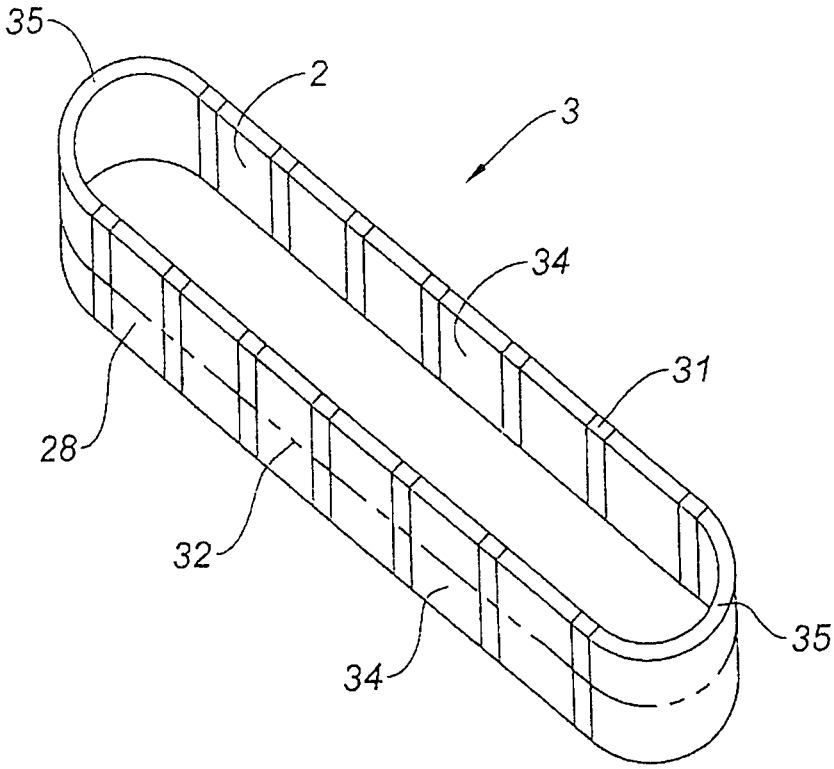
FIG. 3 is a perspective view of one example of an insert obtained according to the method of manufacture of the invention.

One first technique for maintaining the shape of the insert 3 is to provide, at the start of winding, a step of winding a first metal foil that secures the internal part of the insert 3 and to provide, at the end of winding, a step of winding a second metal foil 28 that secures the external part of the insert 3. In this example, the first metal foil constitutes the component of revolution 2. The coated filaments 32 therefore find themselves between the foils 2 and 28 as depicted in FIG. 3.

Moreover, as illustrated in FIG. 2, each end plate 21 and 22 has slots 23 on its periphery 27. Each slot 23 of the end plate 21 is positioned facing a slot 23 of the end plate 22, thus forming a pair of slots 23. The fitting of metal bands 31 is made easier by the dimensions of the slots 23 extending toward the inside of the end plates 21 and 22 over a depth d. The depth d of the slots 23 has to be such that it is possible to access the hollow inside 29 of the component of revolution 2, which is positioned around a hub of the winding device 20, not visible in FIG. 2, comprising an alternation of slots and of teeth, the slots of the hub being in register with the slots 23 of the end plates 21 and 22. The depth d extends beyond the winding surface of the component of revolution 2.

Each pair of slots 23 is intended to allow the attachment of a metal band 31. The metal bands 31 are made of a metallic material identical to that of the container 4, described in conjunction with FIG. 4, and of the component of revolution 2. The metal bands 31 are fixed around the insert 3 by a contact welding process. The metal bands 31 are positioned at regular intervals along the wound insert 3.

Once the insert 3 has been wound and the metal bands 31 have been fitted, this can be removed from the winding device 20 by detaching the end plates 21 and 22 from one another. An example of an insert 3 thus obtained is depicted in FIG. 3. This consists of a component of revolution of oblong shape comprising two rectilinear and parallel portions 34 fitted in between two circular portions 35.

A second technique for keeping the insert 3 in shape, that does not involve the use of bands 31, is to provide a component of revolution 2 forming an oblong mandrel comprising at least one radial rim, for example with an L-shaped or U-shaped cross section, onto which the filaments 32 are wound. When a bonded lap of coated filaments 32 is used, it is possible to secure it to the component of revolution 2 onto which it is wound and to the lap of the layer below using a method of contact welding between two electrodes and by passing a medium frequency current. The filaments 32 are thus welded together as winding progresses which means that when the insert 3 is removed from the winding device 20, it forms a component as one with the component of revolution 2.

Figure 4:
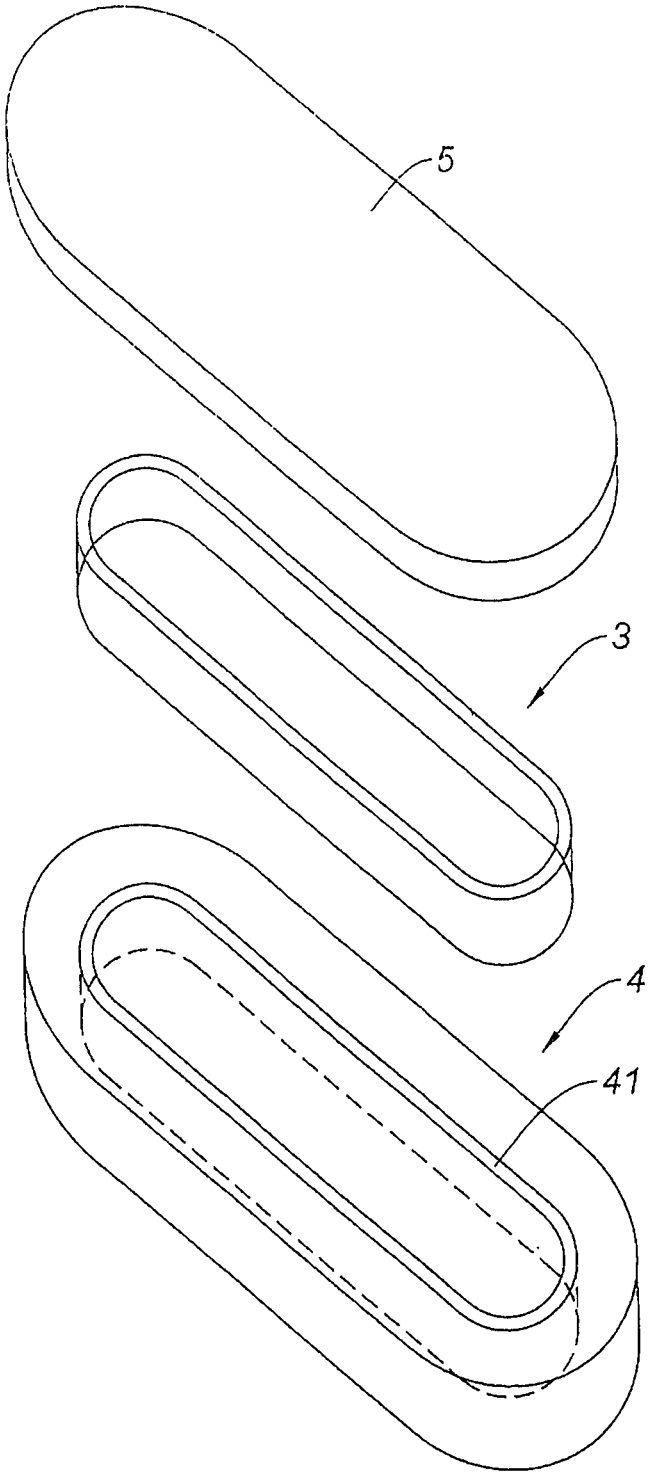
FIG. 4 is one example of an insert, of a container intended to accommodate the insert and of a metal lid intended to seal the container and the insert.

The insert 3 is then inserted in a container 4, as depicted in FIG. 4. The container 4 for this purpose comprises a groove 41 of a shape that complements the insert 3 and into which the insert 3 is housed. The container 4 forms the preform of the metal alloy matrix, preferably made of titanium Ti. A lid 5 is attached to the container 4 by electron welding, is evacuated, then compacted using a hot isostatic compaction process.

Figure 5:
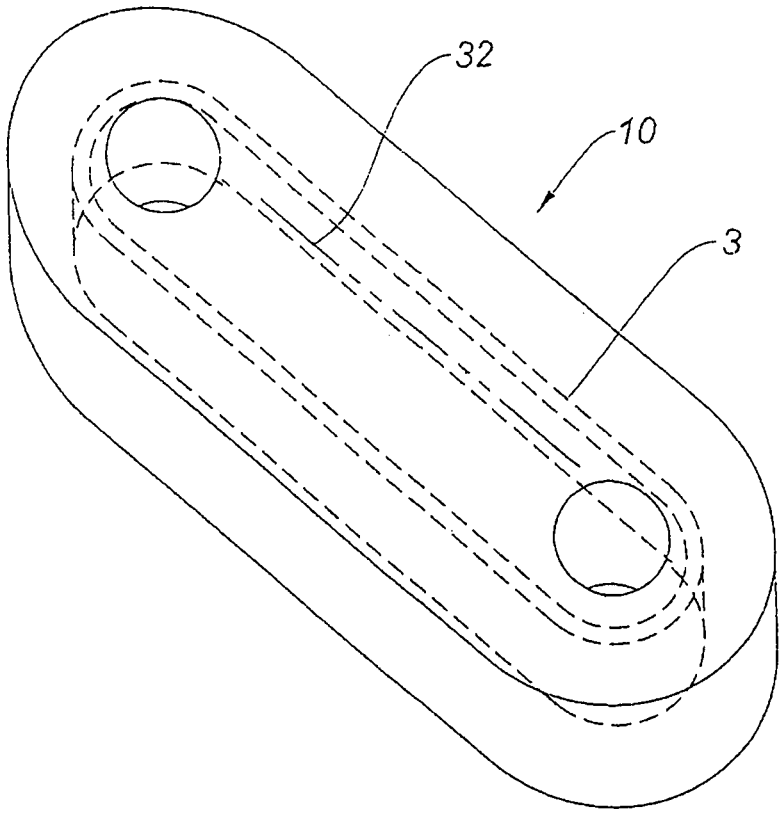
FIG. 5 is a perspective view of one example of a mechanical component obtained according to the method of manufacture of the invention.

The whole is then machined to obtain the finished mechanical component 10: a rod 10, depicted in FIG. 5. The rod 10, identical in shape to the rod 1 in FIG. 1, further comprises a composite insert 3 having a geometry of revolution, the filaments 32 of which are partly directed in a rectilinear direction. This rectilinear direction is perpendicular to the axes Z1 and Z2. This rod 10 is advantageously able to transmit one-way tensile and/or compressive forces. The rectilinear portions 34 of the inserts 3 comprise filaments that are all directed in one and the same rectilinear direction.

The invention applies to any type of mechanical component the function of which is to transmit a tensile and/or compressive force mainly in one direction and is therefore not restricted solely to rods, which are just one application example.

Figure 6:
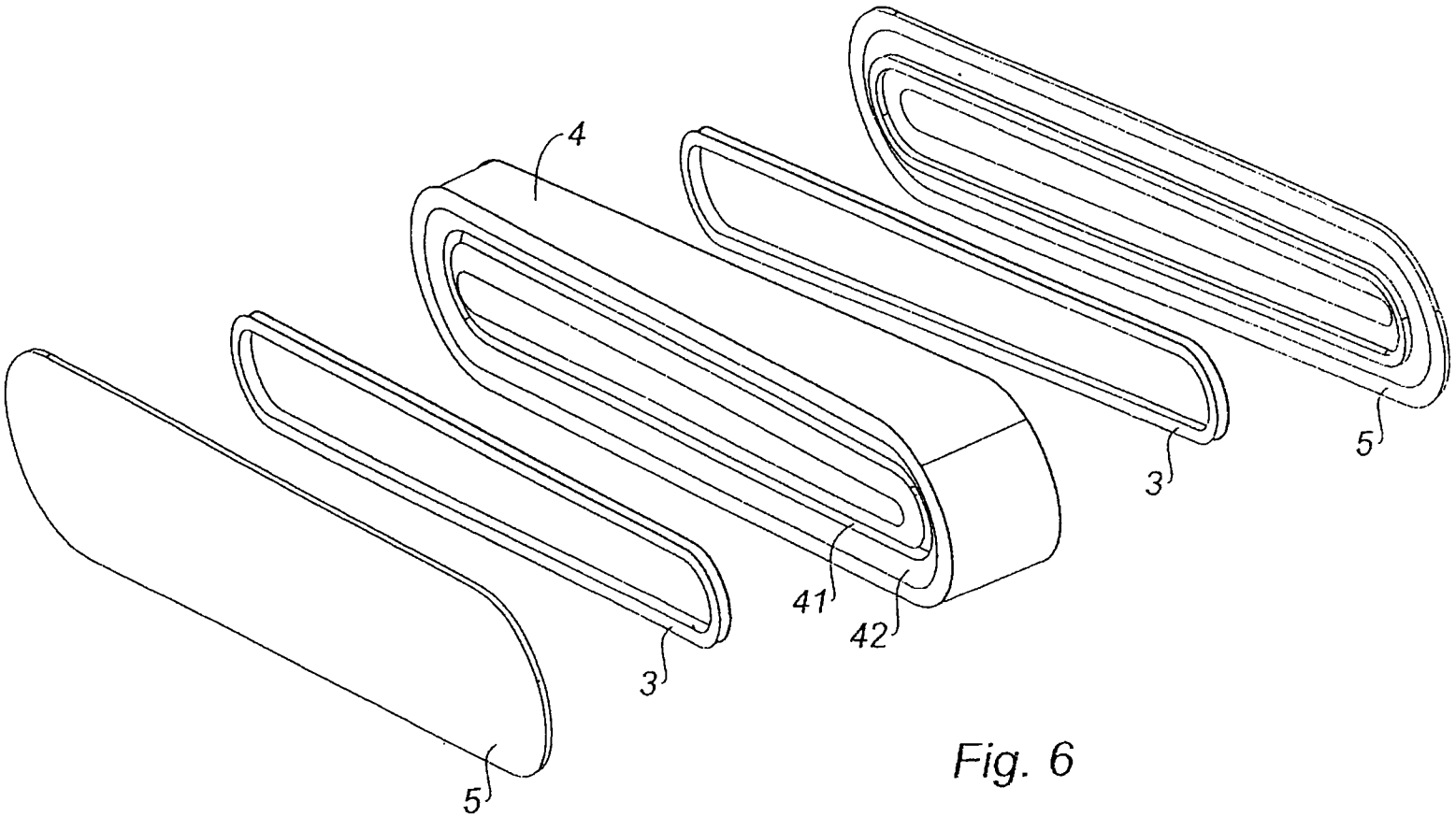
FIG. 6 is an alternative form of the method of manufacture of the invention.
Figure 7:
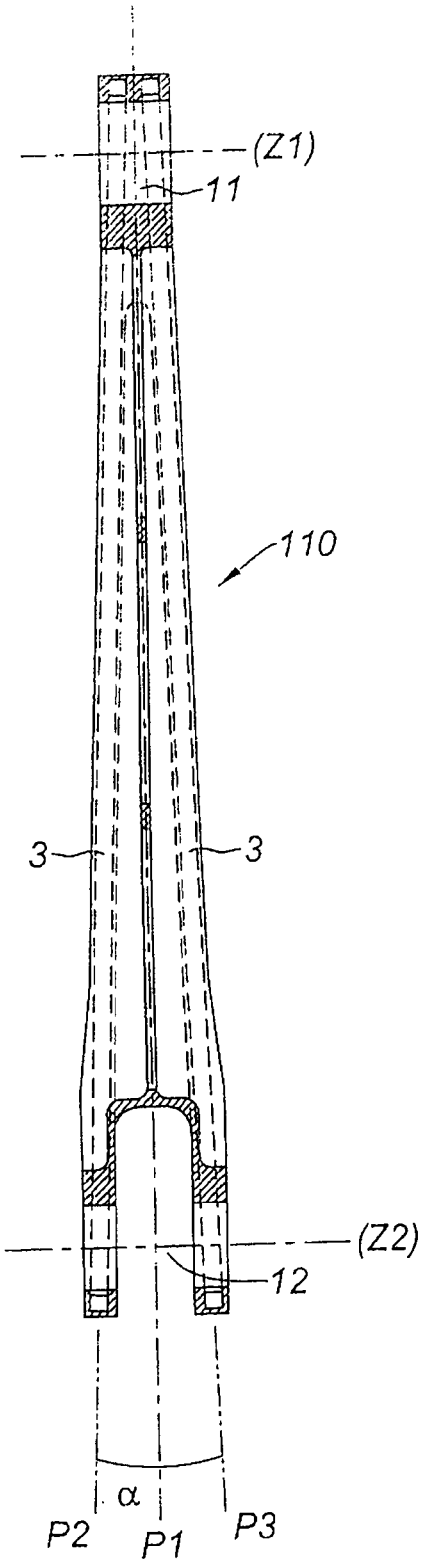
FIG. 7 is a cross section through another example of a mechanical component obtained according to the alternative form of the method of manufacture of the invention.
Figure 8:
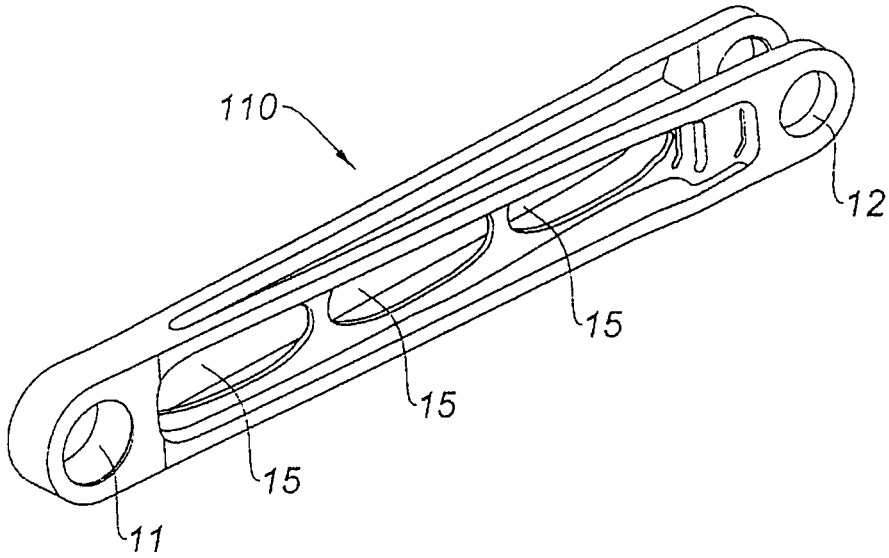
FIG. 8 is a perspective view of the example of a mechanical component obtained according to the alternative form of the method of manufacture of the invention.

According to an alternative form of the invention, the mechanical component may be of more complex shape and comprise a plurality of inserts 3 which can each have a geometry of revolution, that is to say a geometry that describes a closed structure, usually curved. In the example depicted in FIG. 6, the method of manufacture is modified by using a container 4 which comprises, on each side of two of its opposing faces 42, grooves 41 intended to accommodate inserts 3. Following hot isostatic compaction and machining, the mechanical component 110 obtained is that depicted in FIG. 7 and thus comprises inserts 3. The inserts 3 are positioned on each side of a mid-plane P1 of the mechanical component 110. They are positioned in planes P2 and P3 that are at a non-zero angle $\alpha$ to one another. FIG. 8 is a perspective view of a mechanical component 110 thus obtained. This mechanical component 110 may equally have recesses 15 intended to reduce the weight thereof.

Such mechanical components 10 or 110 are perfectly suited to aeronautical applications, for example to undercarriages or to the turbomachines intended for an aircraft.

The invention claimed is:

1. A mechanical component comprising:

at least one insert made of metal matrix composite, within which insert matrix ceramic fibers extend, the composite insert being obtained from a plurality of coated filaments each comprising a ceramic fiber coated with a metal sheath, the insert being part of the mechanical component, wherein the insert has a geometry of revolution including two rectilinear and parallel portions which are disposed between two opposite facing arcuate portions, the two arcuate portions and the two rectilinear portions extending in a same plane, and wherein the filaments of the rectilinear portions are all directed in a same rectilinear direction.

2. The mechanical component as claimed in claim 1, comprising at least two inserts positioned on each side of a midplane of the mechanical component.

3. The mechanical component as claimed in claim 2, wherein the two inserts are positioned in planes that are at an angle to one another.

4. The mechanical component as claimed in claim 1, wherein the mechanical component is a rod presenting an elongate shape in which a length of the rectilinear portions in the rectilinear direction is greater than a distance between the rectilinear portions in a direction perpendicular to the rectilinear direction.

5. An undercarriage comprising at least one mechanical component as claimed in claim 1.

6. A turbomachine comprising at least one mechanical component as claimed in claim 1.

7. An aircraft comprising:

a mechanical component as claimed in claim 1;

an undercarriage or a turbomachine.

8. The mechanical component as claimed in claim 1, wherein the two arcuate portions are circular.

* * * * *